US011008840B2

(12) United States Patent
Sheng

(10) Patent No.: US 11,008,840 B2
(45) **Date of Patent: *May 18, 2021**

(54) METHOD FOR OPTIMIZATION OF HUFF-N-PUFF GAS INJECTIONS IN HYDROCARBON RESERVOIRS

(71) Applicant: Texas Tech University System, Lubbock, TX (US)

(72) Inventor: James J. Sheng, Lubbock, TX (US)

(73) Assignee: Texas Tech University System, Lubbock, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/694,817

(22) Filed: Nov. 25, 2019

(65) Prior Publication Data

US 2020/0088016 A1 Mar. 19, 2020

Related U.S. Application Data

(63) Continuation of application No. 15/372,214, filed on Dec. 7, 2016, now Pat. No. 10,487,635.

(60) Provisional application No. 62/263,865, filed on Dec. 7, 2015.

(51) Int. Cl.

| | |
|---|---|
| ***E21B 43/16*** | (2006.01) |
| ***E21B 47/06*** | (2012.01) |
| ***G01V 99/00*** | (2009.01) |

(52) U.S. Cl.

CPC ..... *E21B 43/168* (2013.01); *E21B 47/06* (2013.01)

(58) Field of Classification Search

CPC ..... E21B 43/24; E21B 43/168; E21B 47/06

See application file for complete search history.

(56) References Cited

U.S. PATENT DOCUMENTS

| | | | | |
|---|---|---|---|---|
| 9,932,808 | B2 * | 4/2018 | Sheng | E21B 43/164 |
| 10,487,635 | B2 * | 11/2019 | Sheng | E21B 47/06 |
| 2007/0175638 | A1 * | 8/2007 | Crichlow | E21B 43/24 166/302 |
| 2010/0252271 | A1 * | 10/2010 | Kelley | E21B 43/122 166/370 |
| 2013/0105179 | A1 * | 5/2013 | Lieberman | E21B 43/006 166/402 |
| 2017/0074082 | A1 * | 3/2017 | Palmer | E21B 43/24 |
| 2017/0159416 | A1 * | 6/2017 | Sheng | E21B 43/24 |

(Continued)

FOREIGN PATENT DOCUMENTS

| | | | | |
|---|---|---|---|---|
| CA | 2114456 | A1 * | 7/1995 | E21B 43/24 |

*Primary Examiner* — Daniel P Stephenson

(74) *Attorney, Agent, or Firm* — Dickinson Wright PLLC; Ross Spencer Garsson

(57) ABSTRACT

Methods for optimization of liquid oil production by huff-n-puff in shale reservoirs to achieve an improved (and optimal) oil recovery factor. The process determines and utilizes the optimum huff and puff times, number of cycles and soaking time under practical operation and reservoir conditions. The huff time in the process is a period so long that the pressure near the wellbore reaches the set maximum injection pressure during the huff period. The puff time in the process is the time required for the pressure near the wellbore to reach the set minimum production pressure during the puff period. Soaking is typically not necessary during the huff-n-puff gas injection in shale oil reservoirs. The number of huff-n-puff cycles is determinable by the time in which the economic rate cut-off is reached.

8 Claims, 12 Drawing Sheets

(56) References Cited

U.S. PATENT DOCUMENTS

2018/0347328 A1* 12/2018 Aguilera ..... E21B 43/26
2020/0088016 A1* 3/2020 Sheng ..... E21B 43/168

* cited by examiner 100 days of huff time 300 days of huff time

METHOD FOR OPTIMIZATION OF HUFF-N-PUFF GAS INJECTIONS IN HYDROCARBON RESERVOIRS

CROSS-REFERENCE TO RELATED PATENT APPLICATIONS

This application is a continuation application of U.S. patent application Ser. No. 15/372,214, filed Dec. 7, 2016, entitled "Method For Optimization Of Huff-N-Puff Gas Injection In Shale Reservoirs", which claims priority to U.S. Patent Appl. Ser. No. 62/263,865, filed Dec. 7, 2015, entitled "Method For Optimization Of Huff-N-Puff Gas Injection In Shale Reservoirs." The foregoing patent applications are hereby incorporated herein by reference in their entirety for all purposes.

GOVERNMENTAL INTEREST

This invention was made with United States Government support under Grant No. DE-FE0024311 awarded by the Department of Energy. The Government may have certain rights in the invention.

FIELD OF INVENTION

The present invention generally relates to the production of liquid oil from shale reservoirs. More particularly, the present disclosure relates to methods for optimization of liquid oil production by huff-n-puff in shale reservoirs to achieve an improved (and optimal) oil recovery factor.

BACKGROUND

Huge shale resources available and low gas price turn the oil operators' activities to producing more liquid oil. Common enhanced oil recovery methods can be divided along three different techniques: thermal injection, gas injection, and chemical injection to extract oil from the reservoirs.

Thermal injection uses hot water and steam to extract crude oil from the reservoir. Thermal injection is used for heavily viscous oil that cannot easily flow without adding heat, as the increased temperature reduces the oil's viscosity. Thermal injection has dominated the oil recovery market for 2012 and is utilized heavily by Canada, Indonesia, and California. [TMR 2014]. However, given the high price of the natural gas that is needed to heat the steam, its market share is expected to decrease during the next decade.

Gas injection technology injects gases to extract oil. The most common used gas is carbon dioxide ($CO_2$) since it is an abundant byproduct of industrial processes. In Northern America, many of the carbon dioxide enhanced oil recovery projects are concentrated in West Texas.

Chemical injection technology uses polymer, surfactant solution and alkali to extract crude oil from the reservoirs and can be incorporated in conjunction with another injection method for further efficiency.

Presently, North America leads the World in the enhanced oil recovery market, followed by Europe (especially Russia). Currently, it appears there is no necessity for the Middle East to utilize enhanced oil recovery methods for oil extraction (given the region's abundant resources), this is expected to change and it is anticipated that enhanced oil recovery will play a significant role in the Middle East in the coming years.

It is well known that primary depletion using horizontal wells with multistage fracturing can only produce a few present of the oil in shale reservoirs. Compared to gas flooding, huff-n-puff has more operation parameters to optimize so that liquid oil production can be maximized. Nonetheless, the question as to how to produce the remaining oil has not been addressed or answered. This question becomes more important in the current low oil price, as high-cost drilling, fracturing and completion have to be minimized.

Thus, using existing wellbores to improve remaining oil production becomes more important. Considering different enhanced oil recovery methods, gas injection is probably the most feasible method. [Sheng 2015 A; Sheng 2015 C]. Since Wan 2013 A first proposed cyclic gas injection (huff-n-puff) to improve oil recovery in shale oil reservoirs, many papers have been published on the subject, as reviewed by Sheng 2015 A. Sheng 2014 used a simulation approach to show that cyclic gas injection has the highest potential to enhance oil recovery (EOR) in shale oil reservoirs. Chen 2014 used compositional models of a Bakken formation to simulate $CO_2$ huff and puff. Their results show that the final recovery factor in the huff and puff process is lower than that in the primary recovery, because the incremental recovery in the production stage is unable to compensate the loss in the injection and shut-in stages. In their models, the huff and puff process are from 300 days to 1000 days; the bottom-hole injection pressure is 4000 psi and the producing pressure is 3000 psi. Using this model, Sheng 2015 A was able to repeat Chen 2014 results (the huff-n-puff recovery is lower than the primary recovery). However, this model shows that all the oil recovery factors at the end of 30, 50 and 70 years from the huff and puff process are higher than those from the primary depletion, when the injection pressure of 7000 psi is used. Therefore, Chen 2014's results are caused by the low injection pressure of 4000 psi which is lower than the initial reservoir pressure of 6840 psi. The injection pressure in the high-pressure reservoir should be raised. From this example, a method for enhancement and optimization of huff-n-puff is very important because sometimes a wrong conclusion is made.

Thus, a need remains to improve the huff-n-puff method using a gas (such as methane, natural gas, carbon dioxide, nitrogen, and combinations thereof) to optimize the oil recovery factor in shale reservoirs.

SUMMARY OF INVENTION

The present invention generally relates to the production of liquid oil from shale reservoirs. A process has been discovered to optimize oil recovery factor in a huff-n-puff method in which a gas (such as methane, natural gas, carbon dioxide, nitrogen, and combinations thereof) is injected. The process increases liquid oil production by huff-n-puff in shale reservoirs to achieve an improved (and optimal) oil recovery factor.

In embodiments of the current invention, the maximum injection rate and the maximum injection pressure during the huff period, and the maximum gas and oil production rates and the minimum production pressure during the puff period, are determined by the facility capacities, reservoir conditions, and operation constraints. The huff time utilized is the time period required for the pressure near the wellbore to reach the set maximum injection pressure during the huff period. The puff time selected is the time required for the pressure near the wellbore to reach the set minimum production pressure. In some embodiments, the benefits of soaking may not compensate the loss in injection and production due to the time lost in the soaking period, and, thus, for those embodiments, the soaking step can be eliminated during the huff-n-puff gas injection in shale oil reservoirs. The number of huff-n-puff cycles is determinable by the time in which the economic rate cut-off is reached.

In general, in one aspect, the invention features a method to increase recovery in shale reservoirs utilizing a huff-n-puff gas injection process that includes a plurality of huff periods and a plurality of puff periods. The method includes the step of determining a maximum injection rate and a maximum injection pressure in a well to be utilized during the plurality of huff periods. The method further includes the step of determining the maximum gas rate, the maximum oil production rate, and the minimum production pressure from the well during the plurality of puff periods. The method further the step of setting huff period time for the plurality of huff periods such that pressure near wellbore of the well reaches the determined maximum injection pressure during the huff period. The method further the step of setting puff period time for the plurality of puff periods such that pressure at the near wellbore reaches the determined minimum production pressure. The method further the step of performing cycles of multiple huff processes and puff processes in the huff-n-puff injection process, wherein the huff process is performed for the huff period time and the puff process is performed for the puff period time through the multiple huff and puff cycles.

Implementations of the invention can include one or more of the following features:

The huff-n-puff injection process can not include a soaking step between the huff process and the puff process.

The huff-n-puff injection process can include a soaking period after the huff process and before the puff process in each of the multiple huff and puff cycles.

The huff process can include the injection of a gas selected from the group consisting of methane, natural gas, carbon dioxide, nitrogen, and combinations thereof.

The step of determining the maximum injection rate and the maximum injection pressure during the huff periods can be determined based upon at least one of facility capacities, reservoir conditions, and operation constraints.

The step of determining the maximum gas rate, the maximum oil production rate, and the minimum production pressure during the puff periods can be determined based upon at least one of facility capacities, reservoir conditions, and operation constraints.

The step of determining the maximum injection rate and the maximum injection pressure during the huff periods can include performing a test of the well to determine the time it takes for downhole pressure of the well to reach the maximum injection pressure when starting at the minimum production pressure.

The step of determining the maximum gas rate, the maximum oil production rate, and the minimum production pressure during the puff periods can include performing a test of the well to determine the time it takes for production pressure of the well to reach the minimum production pressure when starting at the maximum injection pressure.

BRIEF DESCRIPTION OF THE DRAWINGS

For better understanding of the present invention, and the advantages thereof, reference is now made to the following descriptions taken in conjunction with the accompanying drawings.

DETAILED DESCRIPTION

The present invention generally relates to the production of liquid oil from shale reservoirs. More particularly, the present disclosure relates to methods for optimization of liquid oil production by huff-n-puff in shale reservoirs to achieve an improved (and optimal) oil recovery factor.

Base Stimulation Model

A validated base model was set up. Several authors [Kurtoglu 2013; Yu 2014] built models using the Middle Bakken data. However, their detailed models are not publically available. And no data which are more completed than the Bakken data are seen in the literature. Thus the Bakken data was used to build a base model.

A compositional simulator, GEM, developed by CMG, was used. Because of flow symmetry, a half-fracture connected through a vertical well was simulated. In the Middle Bakken case, a horizontal well was fractured with 15 fracturing stages. It was assumed that only one fracture was generated at one stage. So the production data from this model represents the 30th of the actual production.

Figure 1:
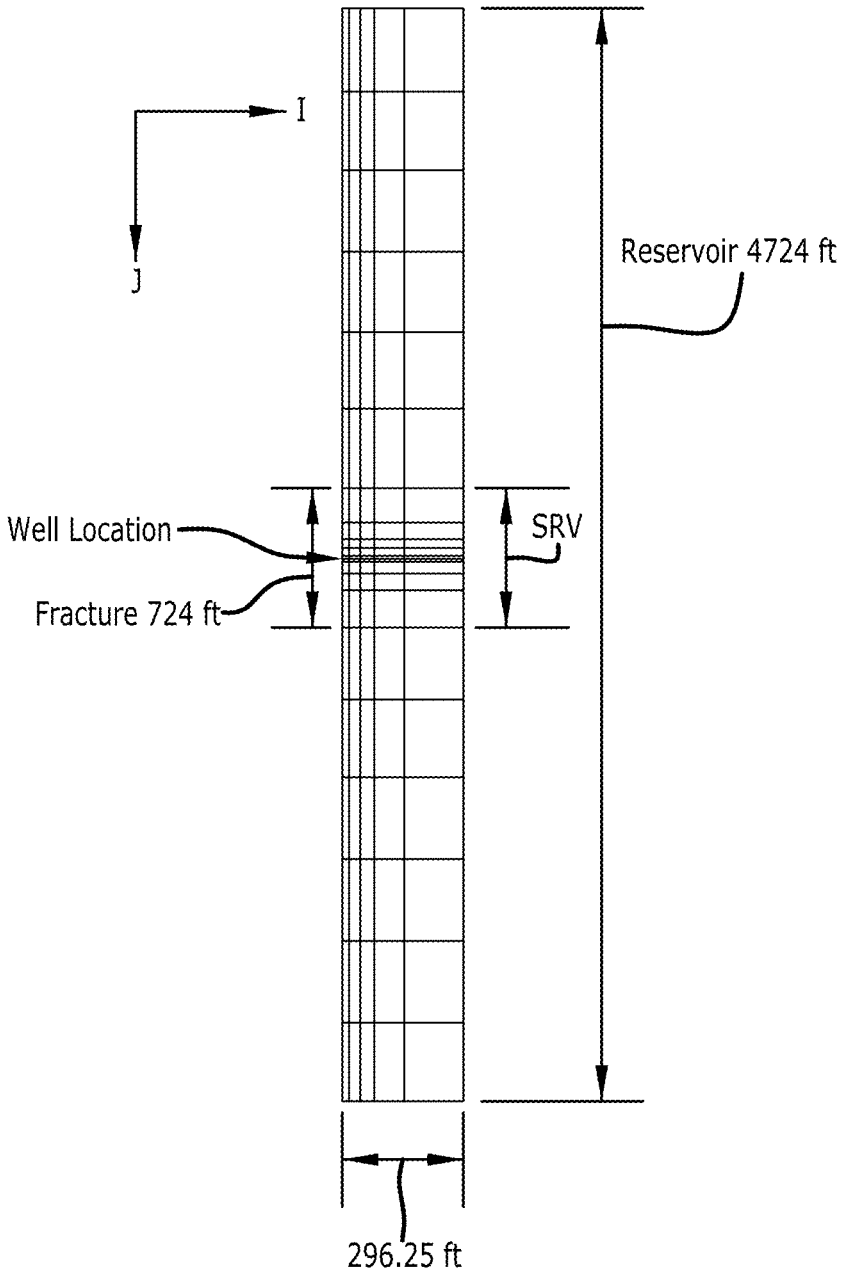
FIG. 1 is a schematic of a base simulation model used for embodiments of the present invention.

The simulation model (reservoir volume) included two regions: the stimulated reservoir volume and un-stimulated reservoir volume. The schematic is shown in FIG. 1. The model area is 296.25 ft wide in the I direction, 4724 ft in the J direction with 724 ft in the SRV area, and 50 ft in the K direction (not shown in FIG. 1). In the model, the half-fracture spacing was 296.25 ft in the I direction, the fracture length was 724 ft in the J direction, and the fracture height was 50 ft in the K direction. The half-hydraulic fracture width was 0.5 ft. The detailed block sizes of this base model were as follows.

The block sizes in feet in the I direction from I=1 to I=11 are:

0.5 0.257312051 0.522150017 1.059571985 2.150134547 4.363156667 8.85392783 17.96681715 36.45913142 73.98462696 150.1331714

The block sizes in feet in the J direction with total 31 blocks are:

5*200 187.1636568 90.39505341 43.65839939 21.08584226 10.18389932 4.918551703 2.375529264 1.147317264 0.554123632 0.267626932 0.5 0.267626932 0.554123632 1.147317264 2.375529264 4.918551703 10.18389932 21.08584226 43.65839939 90.39505341 187.1636568 5*200

One block is used in the K direction with its size 50 feet.

The data of the Middle Bakken formation presented by Kurtoglu 2013 was used. Table 1 summarizes the input matrix and fracture properties in the Non-SRV and SRV regions in the Middle Bakken shale. The dual permeability model was used to simulate the naturally and hydraulically fractured shale reservoirs. The shale matrix permeability was 0.0003 mD. The natural fracture effective permeability in the SRV was 0.0313 mD. The natural fracture permeability in the un-stimulated reservoir region was 0.00216 mD, which was much lower than the stimulated region.

TABLE 1

Matrix and Fracture properties

| | Non-SRV | SRV |
|---|---|---|
| Thickness, ft | 50 | 50 |
| Matrix Permeability, mD | 3.0E−04 | 3.0E−04 |
| Matrix Porosity, fraction | 0.056 | 0.056 |
| Fracture Porosity, fraction | 0.0022 | 0.0056 |
| Fracture Permeability, mD | 2.16E−03 | 3.13E−02 |
| Fracture Spacing, ft | 2.27 | 0.77 |
| Hydraulic fracture porosity, fraction | | 0.9 |
| Hydraulic fracture permeability, mD | | 100 |

Figure 2:
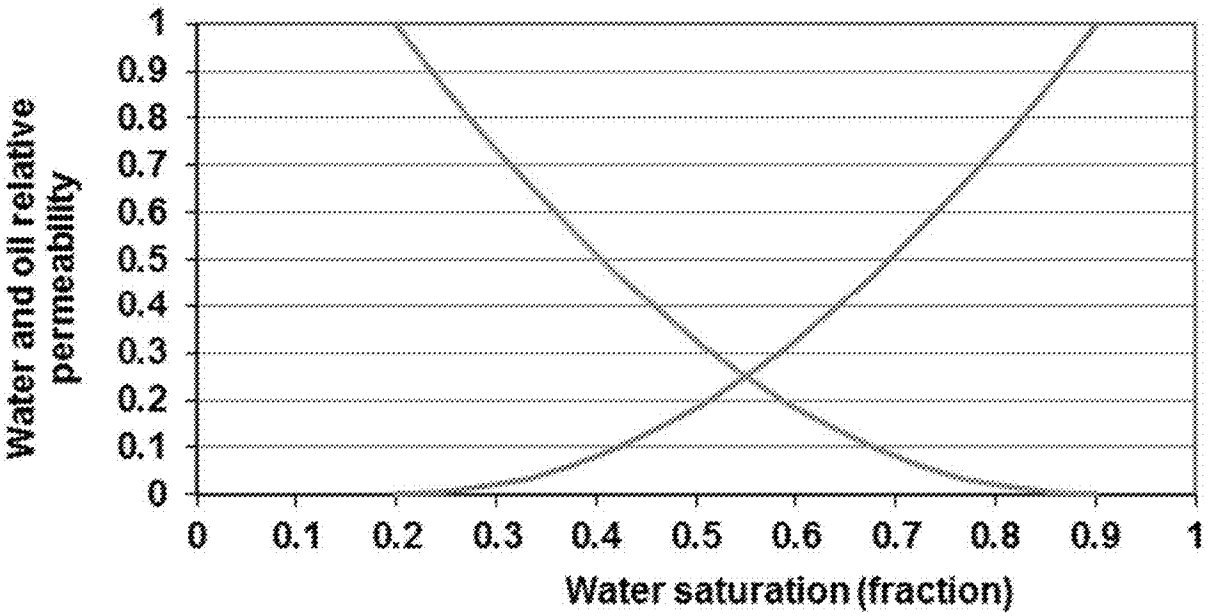
FIG. 2 is a graph reflecting water and oil relative permeabilities of a reservoir analyzed using an embodiment of the present invention.
Figure 3:
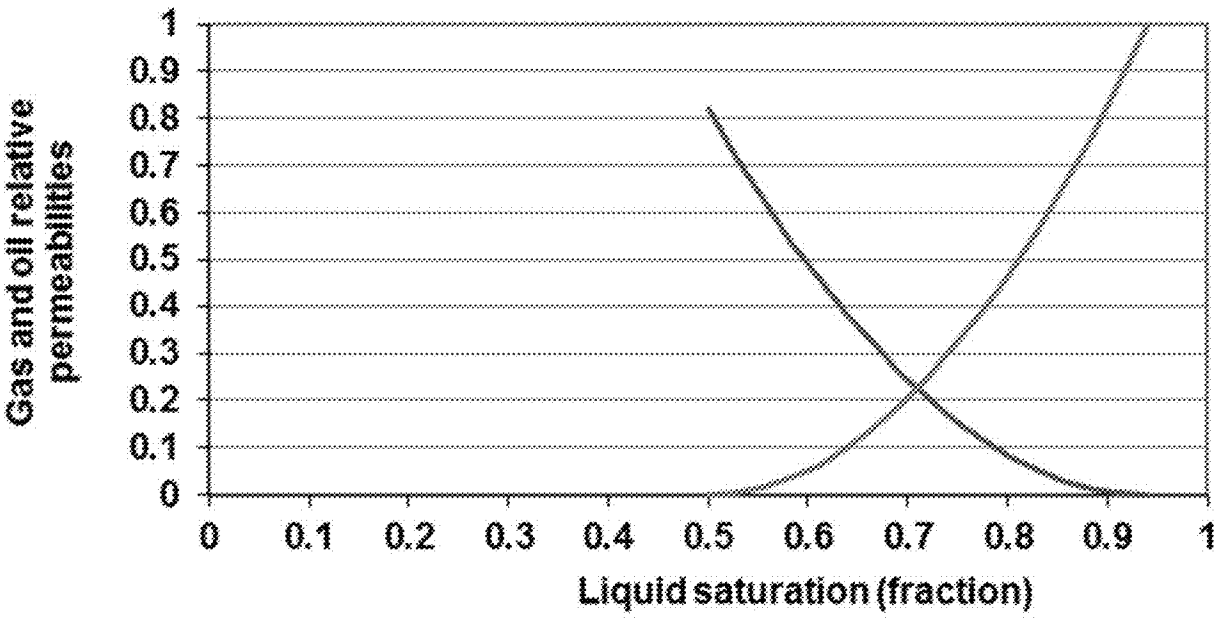
FIG. 3 is a graph reflecting gas and oil relative permeabilities of a reservoir analyzed using an embodiment of the present invention.

The reservoir fluid composition and the Peng-Robinson EOS parameters were from Yu 2014 as re-presented in Table 2, and the binary interaction coefficients used are shown in Table 3. In Table 2, $P_c$, $T_c$ and $V_c$ are critical pressure, critical temperature, and critical volume, respectively, and MW is molecular weight. The reservoir temperature is 245° F., and the initial reservoir pressure is 7800 psi. The initial water saturation is 0.4. The relative permeabilities are presented in FIGS. 2-3.

TABLE 2

Peng-Robinson EOS fluid description of the Bakken oil

| Comp. | Initial mole fraction | $P_c$ (atm.) | $T_c$ (° K) | $V_c$, (L/mol) | Acentric Factor | MW g/mole | Parachor coeff. |
|---|---|---|---|---|---|---|---|
| $CO_2$ | 0.0001 | 72.80 | 304.2 | 0.0940 | 0.013 | 44.01 | 78.0 |
| $N_2$-$C_1$ | 0.2203 | 45.24 | 189.7 | 0.0989 | 0.04 | 16.21 | 76.5 |
| $C_2$-$C_4$ | 0.2063 | 43.49 | 412.5 | 0.2039 | 0.0986 | 44.79 | 150.5 |
| $C_5$-$C_7$ | 0.1170 | 37.69 | 556.9 | 0.3324 | 0.1524 | 83.46 | 248.5 |
| $C_8$-$C_{12}$ | 0.2815 | 31.04 | 667.5 | 0.4559 | 0.225 | 120.52 | 344.9 |
| $C_{13}$-$C_{19}$ | 0.0940 | 19.29 | 673.8 | 0.7649 | 0.1848 | 220.34 | 570.1 |
| $C_{20+}$ | 0.0808 | 15.38 | 792.4 | 1.2521 | 0.7527 | 321.52 | 905.7 |

TABLE 3

Binary interaction coefficients for Bakken oil

| | $CO_2$ | $N_2$-$C_1$ | $C_2$-$C_4$ | $C_5$-$C_7$ | $C_8$-$C_{12}$ | $C_{13}$-$C_{19}$ | $C_{20+}$ |
|---|---|---|---|---|---|---|---|
| $CO_2$ | 0 | | | | | | |
| $N_2$-$C_1$ | 0.1013 | 0 | | | | | |
| $C_2$-$C_4$ | 0.1317 | 0.013 | 0 | | | | |
| $C_5$-$C_7$ | 0.1421 | 0.0358 | 0.0059 | 0 | | | |
| $C_8$-$C_{12}$ | 0.1501 | 0.0561 | 0.016 | 0.0025 | 0 | | |
| $C_{13}$-$C_{19}$ | 0.1502 | 0.0976 | 0.0424 | 0.0172 | 0.0067 | 0 | |
| $C_{20+}$ | 0.1503 | 0.1449 | 0.0779 | 0.0427 | 0.0251 | 0.0061 | 0 |

Figure 4:
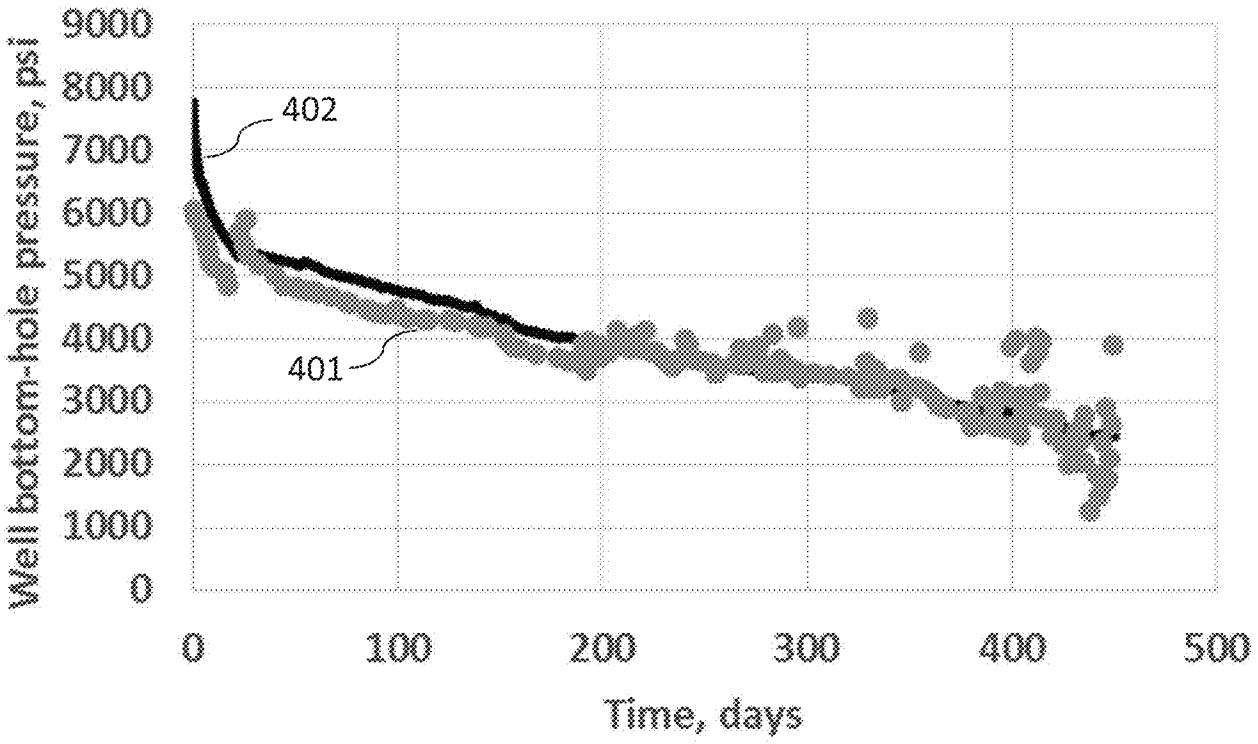
FIG. 4 is a graph reflecting well bottom-hole pressure (actual reflected by dots 401 and simulated reflected by line 402).

This model is the history-matched model. During history matching (1.2 years production history), the stock-tank oil rate was imposed, and effort was made to match gas rate and well bottom-hole pressure by adjusting model parameters. FIG. 4 compares the simulated well bottom-hole pressure (line 402) with the actual data (dots 401). As shown in FIG. 4, The actual and simulated data are reasonably matched. The oil rate is exactly matched because it was input to the model. The gas rate from the model was lower than the actual data, but follow the same trend of actual data. It is believed it was caused by the imperfect representation of PVT data by the EOS model used. Therefore, it is believed that the model was reasonably calibrated.

Figure 5:
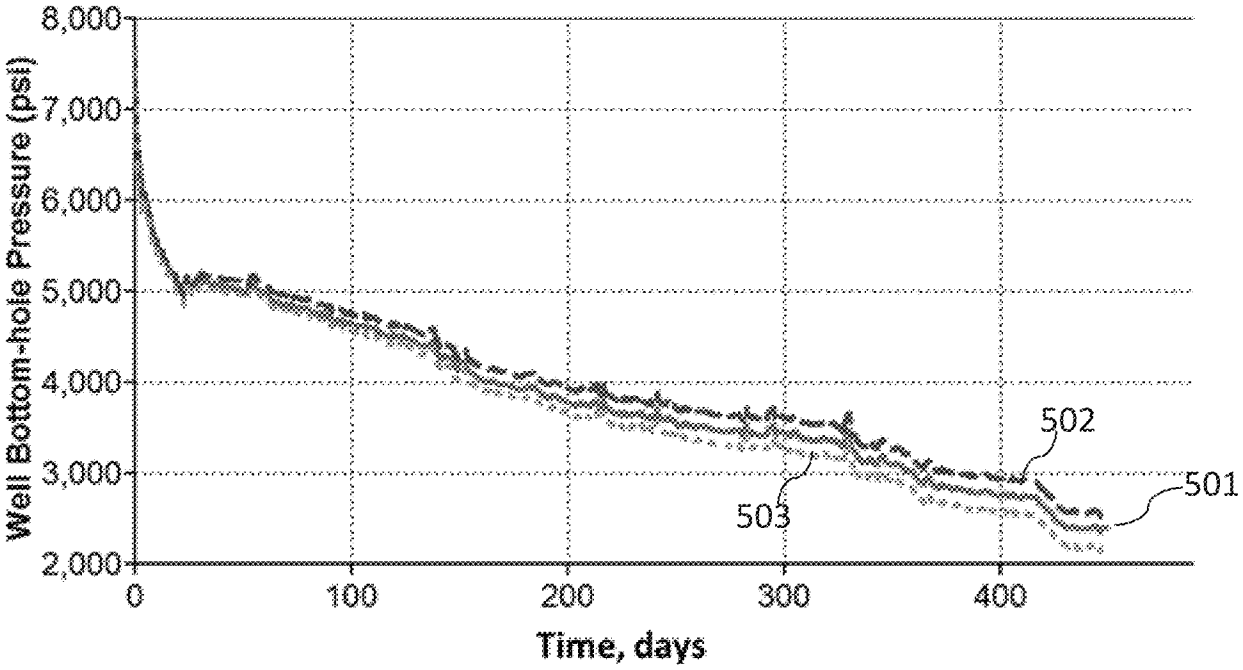
FIG. 5 is a graph reflecting the effect of grid block sizes on well-bottom-hole pressure (base grid 501, double grid 502, and half grid 503).

The effect of grid sensitivity was also checked and confirmed. The number of grid blocks in each direction were doubled and reduced by half. The oil rate, gas rate, and their cumulative values was closely overlapped, except that the bottom hole pressure data was slightly deviated from each other at later times, as shown in FIG. 5. It is believed that any such difference was acceptable in engineering.

Principles

Improving oil recovery is the main motivation to employ the huff-n-puff process. Compared with gas flooding, three important times for a huff-n-puff process are (a) huff time, (b) puff time, and (c) soaking time. These parameters are related to injection and production pressures, and injection and production rates. Therefore, these pressures and rates need to also be addressed (and as was discovered first addressed). These parameters are governed by the facility constraints, e.g., compressor, safety and operation constraint, and a maximum-profit parameters (like net present value).

These are case-specific. Typical values were used to build a base model. In a process evaluated by the present invention, the maximum injection pressure was set to be the initial reservoir pressure (7800 psi). This is a typical practice for pressure maintenance.

The maximum injection rate for the whole fractured horizontal well was set to be 9 MMSCF/D. From the model utilized, a half-fracture for a 15-stage well was simulated. So the maximum rate in the model is 300 MSCF/D. Sheng 2014 showed that a higher oil recovery is obtained if a lower bottom-hole flowing pressure (BHFP) is used, even though the flowing pressure is lower than the minimum miscible pressure. Thus, the minimum bottom-hole flowing pressure was set at 500 psi. The maximum producing oil rate was 1500 STB/D or 50 STB/D in the model. The maximum producing gas rate was 9 MMSCF/D or 300 MSCF/D in the model. Before gas injection, the primary depletion was extended from 1.2 years to about 3 years (1000 days) under the constraint of the minimum flowing pressure of 500 psi. The injection was continued until 10950 days (total about 30 years). The injected gas was methane.

Results

Based on the parameters and principals outlined above, huff time, puff time and soaking time are determined, and the number of cycles is discussed for the improved huff-n-puff process (to improve oil recovery.

Huff and Puff Times

From the literature: (a) Kurtoglu 2013 used 60 days of injection, 10 days of soaking and 120 days of production in her simulation work; (b) Shoaib 2009 used three months in each of injection, soak and production periods; Wang 2010 simulated the EOR potential in the tight (0.04-2.5 mD) Bakken formation in Saskatchewan. In their models, one cyclic process includes 10 years of $CO_2$ injection, 5 years of soaking time, and 5 years of production time. The literature information here shows that the huff and puff times are very different.

Table 4 shows the effect of huff and puff times on oil recovery factor. When the huff time is increased from 100 days (case H100P300) to 300 days (case H300P300), the oil recovery factor increases by 6.15% from 15.05% to 21.2%, with the same puff time of 300 days. This comparison indicated that the huff time was important.

TABLE 4

Effect of huff and puff times

| Case | Huff, days | Puff, days | Oil RF, % |
|---|---|---|---|
| Primary | 0 | 10950 | 11.42 |
| H100P100 | 100 | 100 | 15.12 |
| H100P300 | 100 | 300 | 15.05 |
| H300P300 | 300 | 300 | 21.20 |
| H300P100 | 300 | 100 | 15.38 |
| H300P200 | 300 | 200 | 19.49 |
| H300P350 | 300 | 350 | 20.95 |
| H300P450 | 300 | 450 | 20.57 |
| H300P600 | 300 | 600 | 20.12 |
| H100P100qx3 | 100 | 100 | 23.33 |
| Primarytrans0.33 | 0 | 10950 | 9.46 |
| H100P100trans0.33 | 100 | 100 | 15.53 |

Figure 6A:
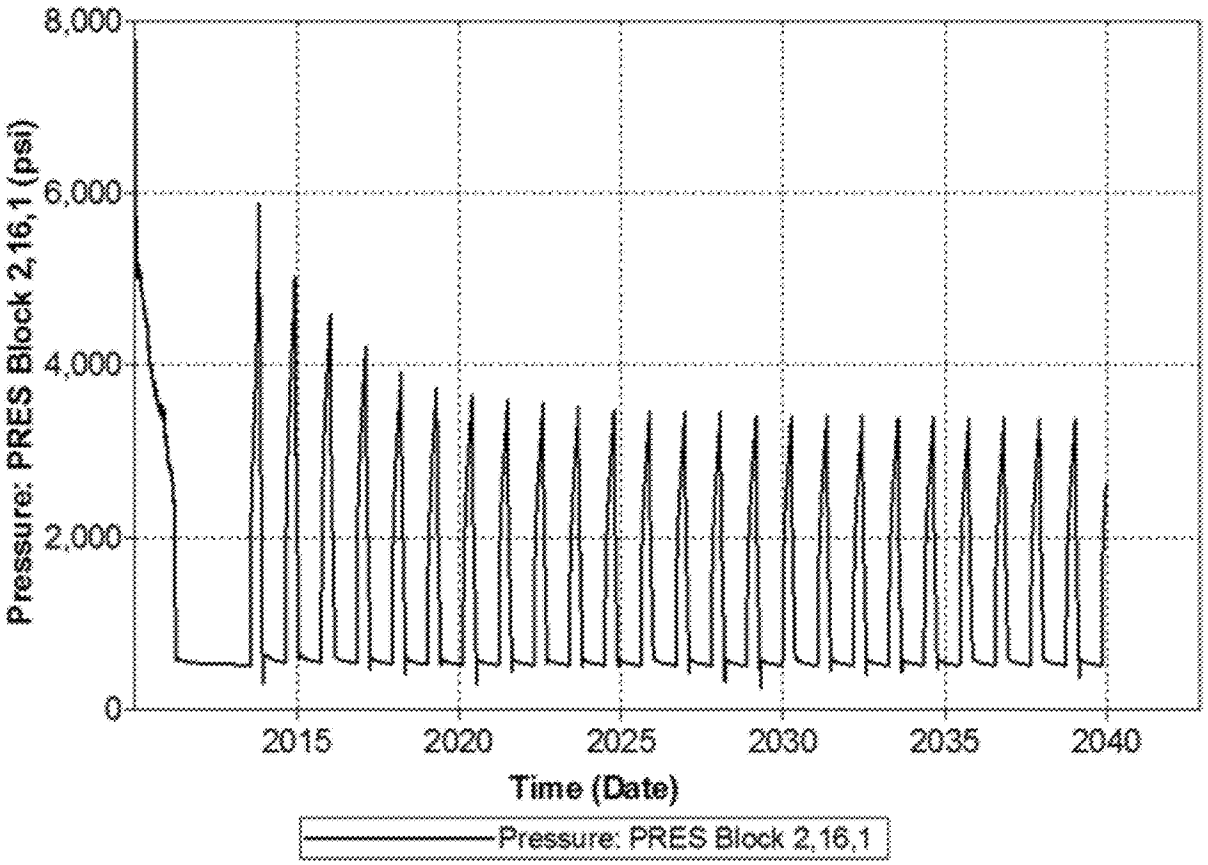
FIGS. 6A-6B are graphs reflecting near-wellbore block pressures when the huff time is 100 days (FIG. 6A) and 300 days (FIG. 6B), with all puff times 300 days.
Figure 6B:
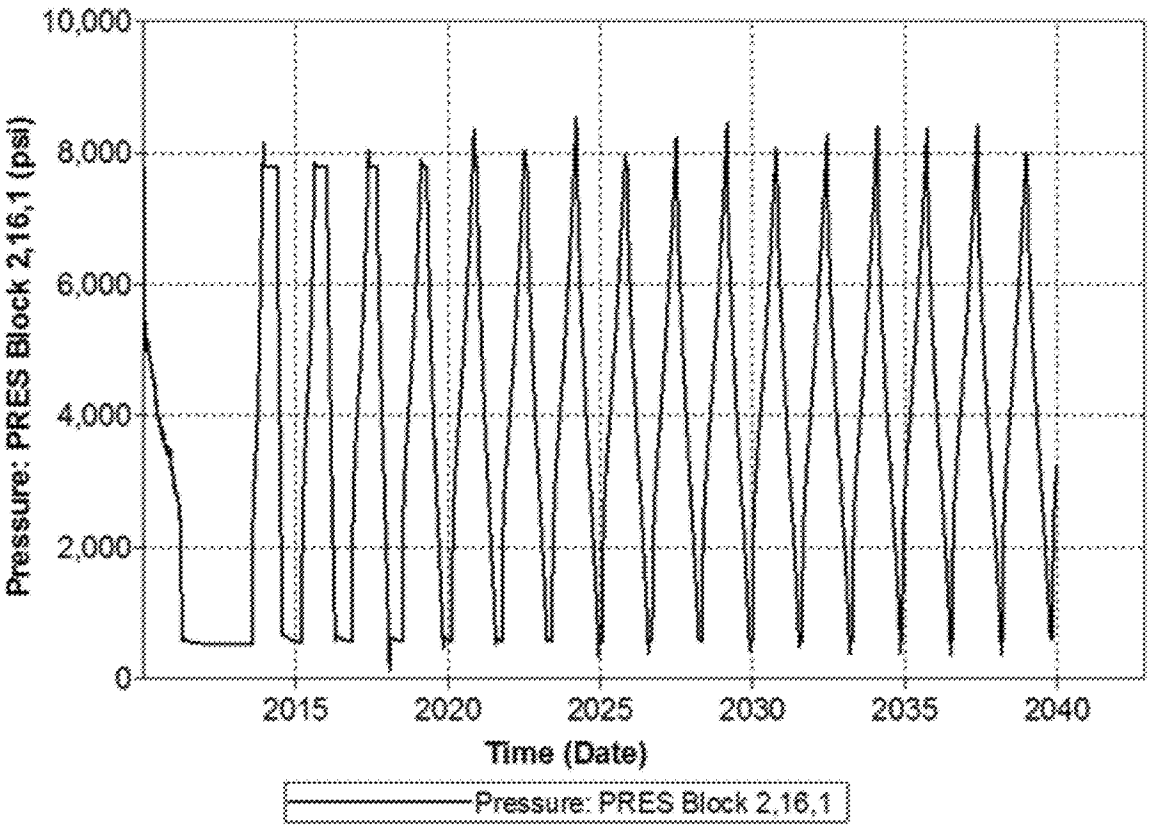

FIGS. 6A-6B compare the block pressures near the injection well for 100 days of huff time (FIG. 6A) with the pressure for 300 days of huff time (FIG. 6B). FIGS. 6A-6B show that the pressure for 100 day huff time is less than 4000 psi, while the pressure for 300 day huff time reaches around 7800 psi. Then the drawdown pressure used to produce oil from the former case is almost half of that for the latter case. For this, it was determined that the huff time of 100 days was not long enough.

However, when the production time was increased from 100 days (case H100P100) to 300 days (case H100P300) with the same huff time of 100 days, the oil recovery factor decreased by 0.07% from 15.12% to 15.05%. From this, it was determined the puff time was not important. When the huff time is 100 days, the pressure near the well is not high. Then the drawdown during the puff period will be low and the oil rate will be low as well. In such case, the rate at later puff period will be low (not productive). Thus, the longer puff time cannot produce significantly more oil in the single cycle. It is even worse that more productive time is lost when the longer puff time is used.

Figure 7:
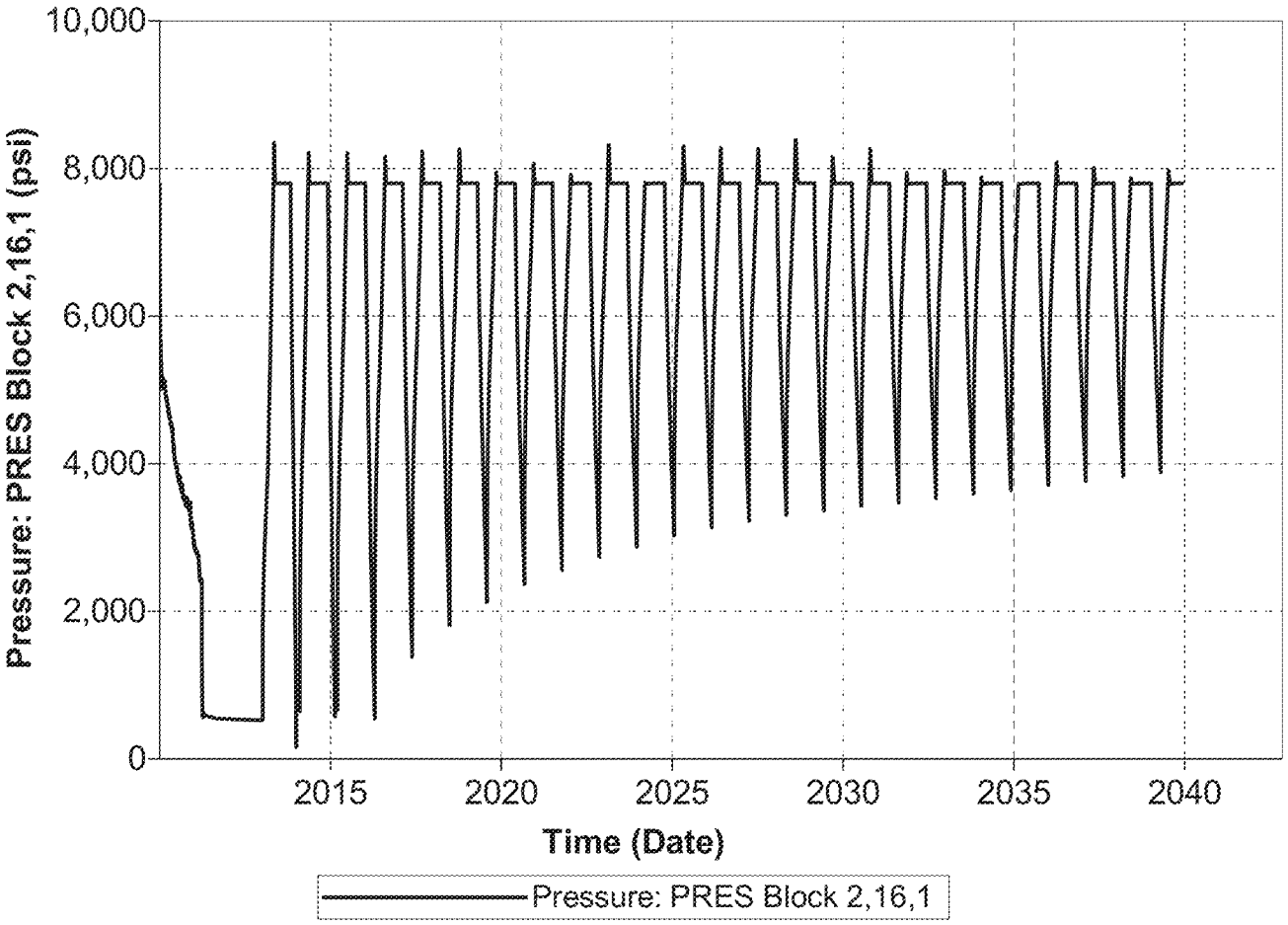
FIG. 7 is a graph reflecting near-well block pressure when the huff time is 300 days but the puff time is 100 days (case H300P100 in Table 4).

From the above, it was seen that the pressure buildup near the well during the huff period was important. As to the import of the pressure drawdown during the puff period, two other cases are compared. One case was case H300P300 in which both huff and puff times were 300 days. In the other case, the huff time was kept at 300 days, but the puff time was changed to 100 days (case H300P100). The oil recovery factors decreased from 21.2% to 15.38%. The well-bottom pressure in case H300P100 is shown in FIG. 7. FIG. 7 reveals that the pressure was not depleted to the set minimum production pressure of 500 psi at the end of 100 days of puff. By this time, the well was switched to the huff mode. Then the effective production was lost. To further confirm this result, another case with the huff time 300 days and puff time 200 days (case H300P200) was examined. The oil recovery factor was 19.49%, lower than that from case H300P300 but higher than that from case H300P100.

As to whether the oil recovery increased when the puff time was further increased, three more cases with the same huff time of 300 but the puff times extended to 350, 450 and 600 days, H300P350, H300P450 and H300P600, were examined. The oil recovery factors were 20.95%, 20.57% and 20.12%, respectively, (see Table 4), which are all lower than that from case H300P300. The near-wellbore block pressures during the huff and puff were slightly lower than those in case H300P300 (data not shown). Also, the oil rate after 300 days were very small so that extended production may not be effective.

It was determined that to maximize the oil recovery factor, the huff time to utilize is when the block pressure near-wellbore reaches the set maximum injection pressure, and the puff time to utilize is when the block pressure near-wellbore reaches the set minimum production pressure. (As noted above, the maximum injection rate and the maximum injection pressure during the huff period, and the maximum gas and oil production rates and the minimum production pressure during the puff period are determined by the facility capacities, reservoir conditions, and operation constraints).

Figure 8:
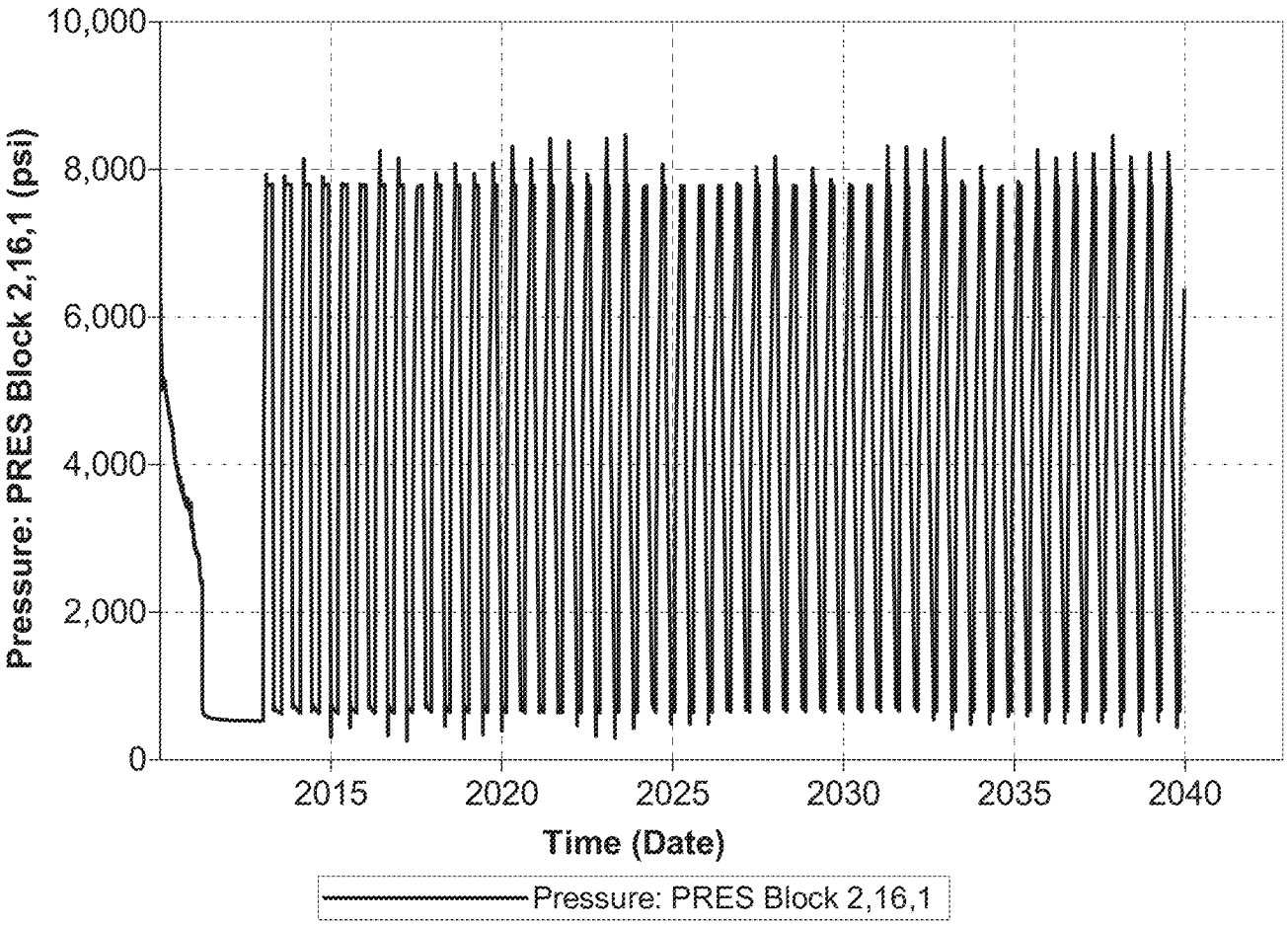
FIG. 8 is a graph reflecting near-well block pressure when the huff and puff time are 100 days but high rate (case H100P100qx3 in Table 4).

As further confirmation, additional cases were examined. Based on case H100P100, another case H100P100qx3 was examined. In this case, the maximum injection rate and maximum production rate were increased by three times. FIG. 8 shows that the near-wellbore block pressure will reach the maximum set injection pressure during the huff period and the set minimum production pressure during the puff period. The expected oil recovery factor from this case should be close to that from case H300P300 (21.2%). The actual oil recovery factor from this case was 23.3%, which confirms the setting of the huff and puff times maximize the oil recovery factor.

As further confirmation, it the transmissibility is reduced, the near-wellbore block pressure could more easily reach the set maximum injection pressure (7800 psi) during the huff period and the set minimum production pressure (500 psi) during the puff period. Even the huff time and puff time are short like 100 days, then the oil recovery factor will be high or maximized. To show this, the transmissibilities in the primary case (Primary) and the huff-n-puff case (case H100P100) were decreased by three times, and the corresponding new cases, (case Primarytrans0.33 and case H100P100trans0.33) were examined.

Figure 9:
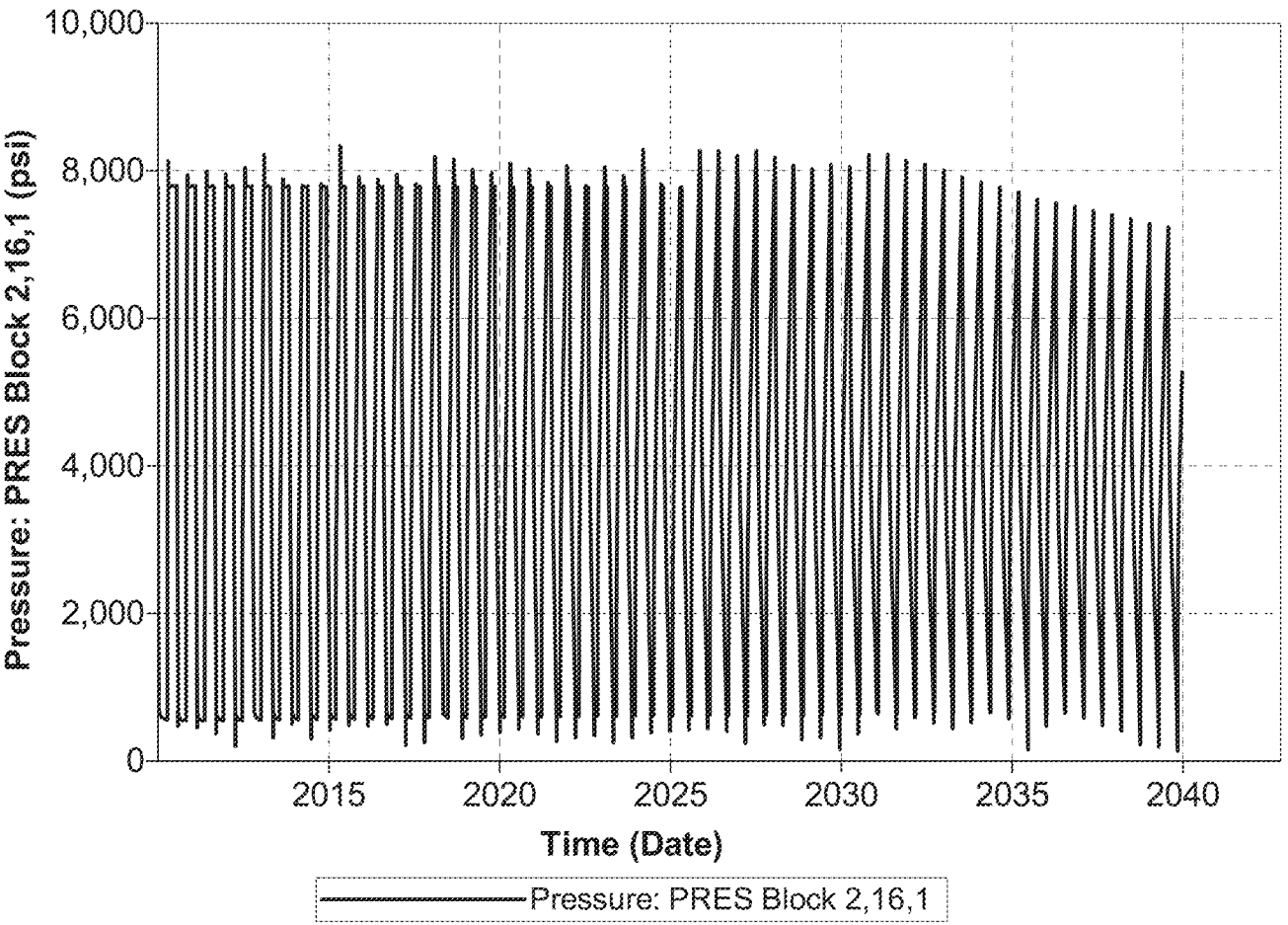
FIG. 9 is a graph reflecting near-well block pressure when the huff and puff time are 100 days with transmissibility reduced by three times (case H100P100trans0.33 in Table 4).

The near-wellbore block pressure in the huff-n-puff case H100P100trans0.33 is shown in FIG. 9. FIG. 9 shows that the pressure reaches the set maximum injection pressure during the huff period and the set minimum production pressure during the puff period. The oil recovery factors for the primary and huff-n-puff cases are 9.46% and 15.53%, respectively (see Table 4), resulting in the incremental oil recovery factor 6.07%.

Soaking Time

From the literature discussed above for the huff and puff times, the soaking times in the literature were quite different. Monger 1988 reported the field tests using the soaking time of 18-52 days, and the results showed the sensitivity of soaking time was not very clear. Their laboratory tests showed soaking time improved recovery of waterflood residual oil in the cores. But the improved oil recovery was mainly from the subsequent waterflooding period. And the total elapse time combining injection and production times was longer with soaking time than the total time without soaking time for those experiments. Gamadi 2013 studied the effects of soaking pressure and soaking time in the laboratory. The oil recovery increased with soaking pressure and soaking time. Their results showed that the oil recovery was dependent more on soaking-pressure than soaking-time. Yu 2015 experimental data also showed higher oil recovery with the longer soaking time. But the total experimental time with longer soaking time becomes longer.

To evaluate the soaking time, the results of the simulations were consistent with the experimental observations. Case H300P300 (huff and puff times are the same—300 days—but no soaking time was compared with case H300S100P300. In case H300S100P300, 100 days of soaking time was added, and the total number of huff and puff cycles remained the same as case H300P300. The total number of cycles for 10950 days is about 17. Thus, the total elapse time was increased to 12650 days (=10950+1700) in the case H300S100P300. The oil recovery factor was 21.39%, higher than 21.2% from case H300P300, as presented in Table 5. This result was consistent with the experimental observations.

TABLE 5

Effect of soaking time

| Case | Huff, days | Soak, days | Puff, days | Oil RF, % |
|---|---|---|---|---|
| Primary | 0 | 0 | 10950 | 11.42 |
| H300P300 | 300 | 0 | 300 | 21.20 |
| H300S100P300ext | 300 | 100 | 300 | 21.39 |
| H200S100P300 | 200 | 100 | 300 | 17.70 |
| H300S5P300 | 300 | 5 | 300 | 21.01 |
| H300S50P300 | 300 | 50 | 300 | 20.71 |
| H300S100P300 | 300 | 100 | 300 | 20.33 |
| H300P300Diff | 300 | 0 | 300 | 23.40 |
| H300S100P300Diff | 300 | 100 | 300 | 22.71 |

Another case (case H200S100P300) was evaluated in which the huff time of 300 days was split into 200 days of huff time and 100 days of soaking time. In this case H200S100P300, the total elapse time is 10950 days, which is the same as the elapsed time of case H300P300. The oil recovery factor was 17.7%, which was lower than 21.2% in case H300P300 (see Table 5). This result is consistent with that from another earlier study by the inventor of the present Application. [See Sheng 2015 B]. The soaking time was not included when evaluating the EOR potential in gas condensate reservoirs for most of the cases simulated. But the effect of soaking time was checked for several simulation cases. The results show that splitting a part of huff time into soaking time did not improve oil recovery.

By keeping the total elapse time (10950 days) and the huff time (300 days) unchanged, soaking times of 5, 50, and 100 days were examined (cases H300S5P300, H300S50P300, and H300S100P300, respectively). The oil recovery factors for these cases are 20.01%, 20.71% and 20.33%, respectively, as shown in Table 5. All of these recovery factors are lower than 21.2% in the case H300P300 (without soaking time). Therefore, soaking time may not be added in field projects.

In earlier work of the inventor, soaking time was not included in the simulations. [See Wan 2013 A; Wan 2013 B; Wan 2014 A; Wan 2014 B; Sheng 2014; Wan 2015]. Meng 2015 likewise did not add soak time in their experiments, when they evaluated the oil recovery potential in shale gas condensate reservoirs by huff-n-puff gas injection.

In the above examination, diffusion was not included because of very long simulation time required and sometimes a convergent solution could not be obtained as Kurtoglu 2013 experienced. However, to examine the soaking time, diffusion could be important and must be considered. Therefore, the diffusion in several models were included to examiner the effect of diffusion. For example, the oil recovery factor from case H300P300Diff became 23.4% by including diffusion in case H300P300 (see Table 5). This recovery factor was higher than 21.2% without including diffusion in case H300P300. When the diffusion was included in case H300S100P300Diff (with soaking time of 100 days), the oil recovery factor was 22.71%. This recovery factor was lower than that in case H300P300Diff without soaking time. (See Table 5). These examinations showed that including diffusion did not change the conclusion about the soaking time effect.

Number of Cycles

Another important parameter about cyclic gas injection is the number of cycles. Artun 2011 did a parametric simulation study of a naturally fractured reservoir (a conventional reservoir), and they found an optimum number of cycles was 2-3 based on net present value. However, Yu 2015 did 10 cycles of huff-n-puff experiments and the cumulative oil recovered continues to increase with the cycle. Wan 2015's history matched the Yu 2015 experiments and the models also predicts the continuous increase with the cycle. Simulation data shows that the cumulative oil recovered increased with the cycle almost linearly when the diffusion was not included in the model.

Figure 10:
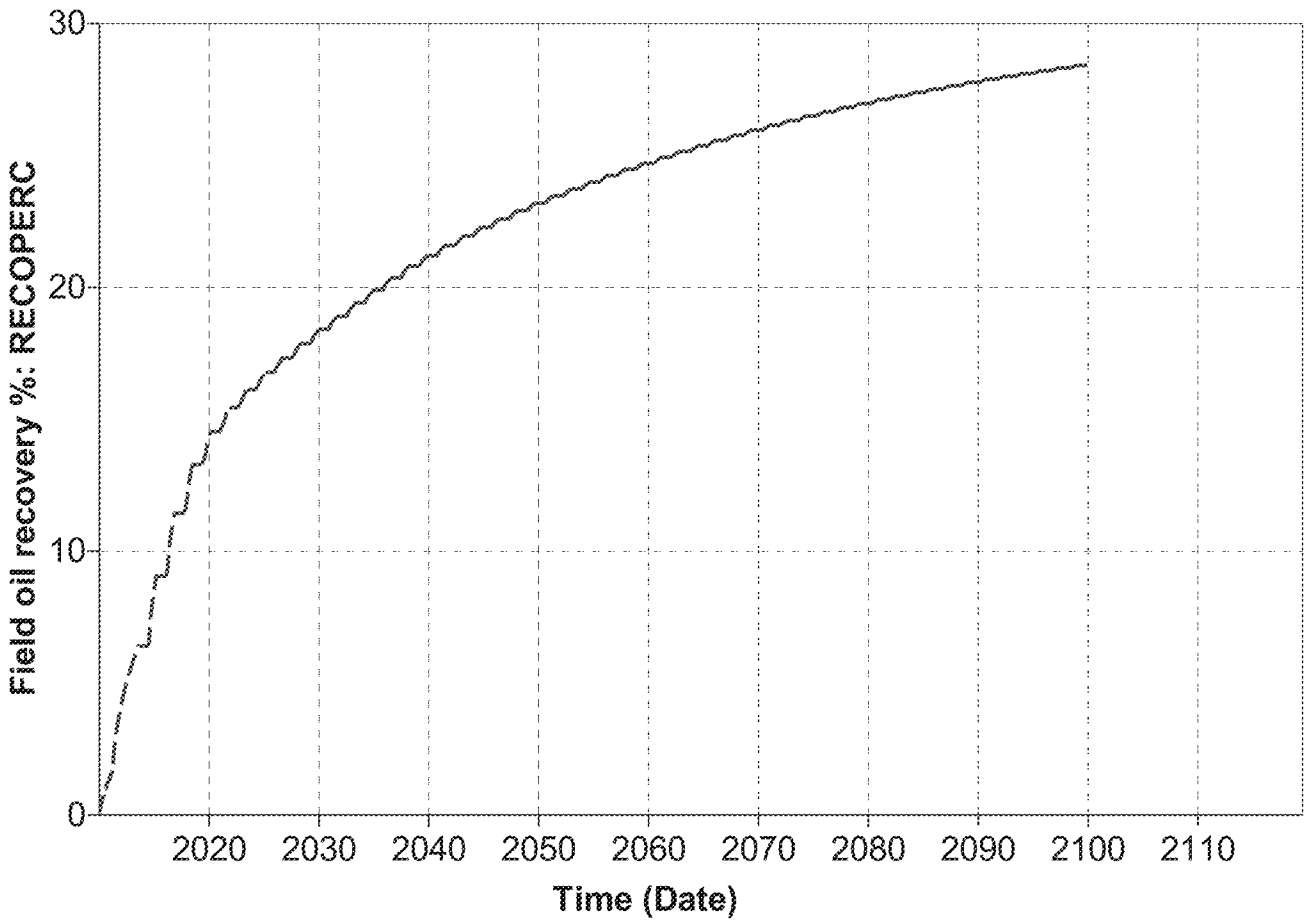
FIG. 10 is a graph reflecting oil recovery factor versus time for case H300P300ext in Table 5.
Figure 11:
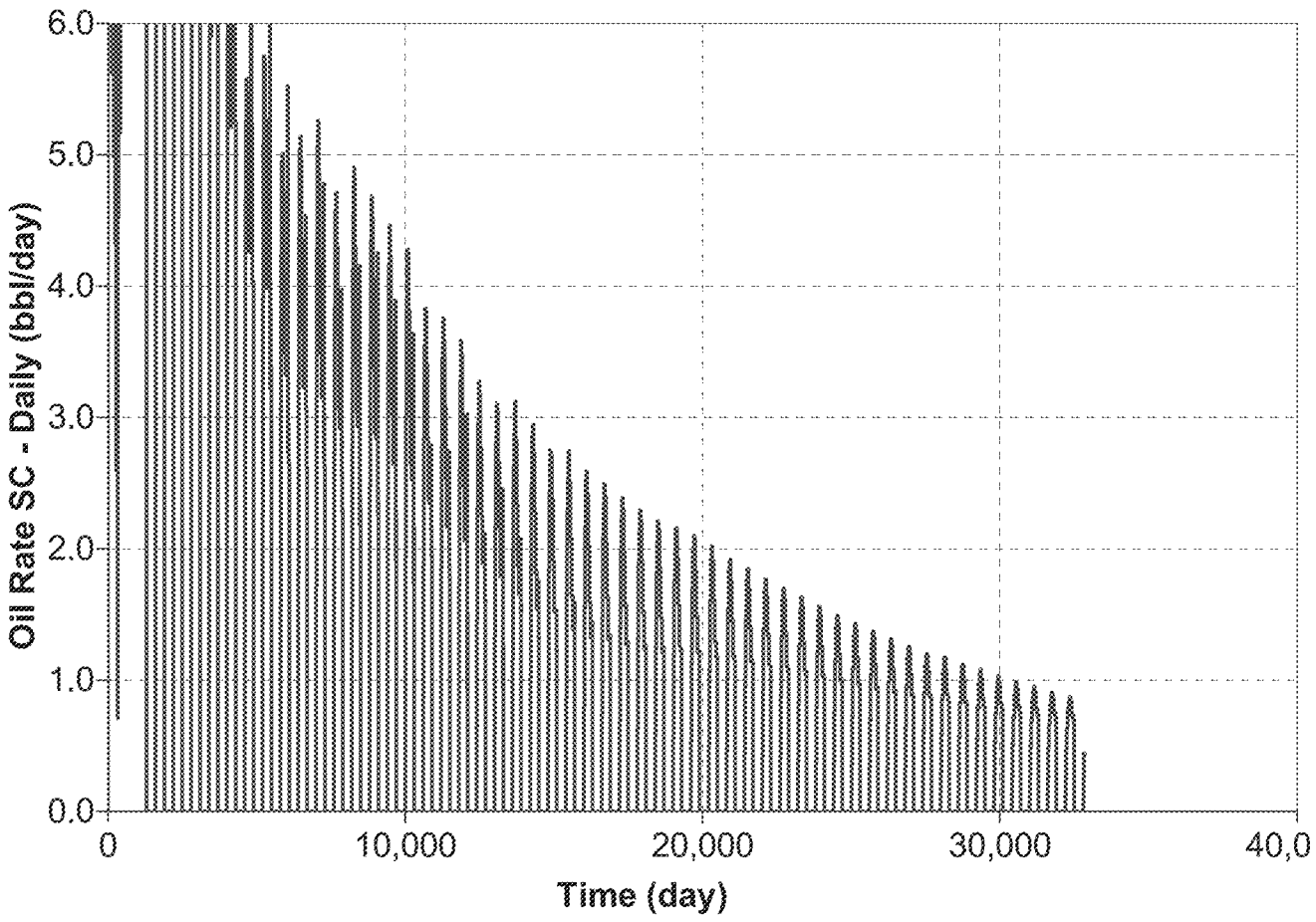
FIG. 11 is a graph reflecting oil rate versus time for case H300P300ext in Table 5.

Case H300P300 was extended from 10950 to 32850 days (about 90 years) to create the case H300P300ext. The cumulative oil recovery factor kept increasing as shown in FIG. 10, although the oil rate decreases with time as shown in FIG. 11, which was interesting. These results indicated that the huff-n-puff process can be continued until an economic rate cut-off was reached Process In embodiments of the present invention, the process is an improved method to increase liquid oil production by huff-n-puff by gas injection in shale reservoirs (i.e., to obtain a higher oil recovery factor), which process includes:

(a) Determining the maximum injection rate and the maximum injection pressure during the huff period;

(b) Determining the maximum gas and oil production rates and the minimum production pressure during the puff period;

(c) Setting the huff time for a period such that the pressure at the near wellbore reaches the set maximum injection pressure during the huff period.

(d) Setting the puff time for a period such that the pressure at the near wellbore reaches the set minimum production pressure.

(e) Performing the huff and puff processes for these huff and puff periods through multiple cycles. Such process can be performed without a soaking period. The benefits of soaking may not compensate the loss in injection and production due to the time lost in the soaking period. Therefore, soaking may not be necessary during the huff-n-puff gas injection in shale oil reservoirs.

This cyclical process can be continued until a rate cut-off is achieved, i.e., the number of huff-n-puff cycles can be determined by economic factors.

The steps of determining the maximum injection rate and the maximum injection pressure during the huff period and determining the maximum gas and oil production rates and the minimum production pressure during the puff period can be based upon one or more of the facility capacities or availability, reservoir conditions, and operation constraints.

The process of setting the huff time for the huff period and setting the puff time for the puff period can also include earlier steps of performing a test of the relevant wellbore to determine the time it takes for the downhole pressure to reach the maximum injection pressure when starting at the minimum production pressure and vice versa.

The examples provided herein are to more fully illustrate some of the embodiments of the present invention. It should be appreciated by those of skill in the art that the techniques disclosed in the examples which follow represent techniques discovered by the Applicant to function well in the practice of the invention, and thus can be considered to constitute exemplary modes for its practice. However, those of skill in the art should, in light of the present disclosure, appreciate that many changes can be made in the specific embodiments that are disclosed and still obtain a like or similar result without departing from the spirit and scope of the invention.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, other embodiments are within the scope of the following claims. The scope of protection is not limited by the description set out above.

Advantages of the using embodiments of the present invention include maximizing oil production rate, maximizing liquid oil offtake, and providing an alternative to the gas or water flooding methods that are not feasible for the low permeability shale reservoirs. Such technology of the present invention thus can be utilized by oil producers to maximize liquid oil production from its shale reservoirs.

RELATED PATENTS AND PUBLICATIONS

The following patents and publications relate to the present invention:

Canadian Patent No. 2114456, "Thermal recovery process for recovering oil from underground formulations," issued Aug. 31, 2004 to Boon et al. ("Boone '456 Patent").

Artun, E., Ertekin, T., Watson, R., Miller, B., 2011. Performance evaluation of cyclic pressure pulsing in a depleted, naturally fractured reservoir with stripper-well production. Petroleum Sci. Technol. 29, 953-965 ("Artun 2011").

Chen, C., Balhoff, B., and Mohanty, K. K., 2014. Effect of Reservoir Heterogeneity on Primary Recovery and $CO_2$ Huff-n-Puff Recovery in Shale-Oil Reservoirs. SPEREE 17(3), 404-413 ("Chen 2014").

Gamadi, T. D., Sheng, J. J., and Soliman, M. Y. 2013. An Experimental Study of Cyclic Gas Injection to Improve Shale Oil Recovery, paper SPE 166334 presented at the SPE Annual Technical Conference and Exhibition held in New Orleans, La., USA, 30 September-2 October ("Gamadi 2013").

Kurtoglu, B. 2013. Integrated reservoir characterization and modeling in support of enhanced oil recovery for Bakken, PhD dissertation, Colorado School of Mines, Golden, Colo. ("Kurtoglu 2013").

Meng, X., Yu, Y, Sheng, J. J., Watson, W., and Mody, F. 2015. An Experimental Study on Huff-n-Puff Gas Injection to Enhance Condensate Recovery in Shale Gas Reservoirs, paper URTeC 2153322 presented at the Unconventional Resources Technology Conference held in San Antonio, Tex., USA, 20-22 July ("Meng 2015").

Monger, T. G., Coma, J. M., 1988. A laboratory and field evaluation of the CO2 process for light oil recovery. SPE Res. Eng. 3 (4), 1168-1176 ("Monger 1988").

Praxair Technology, Inc. 2014. CO2 Huff n' Puff Services for Stimulating Oil Well, at http://www.praxair.com/~/media/praxairus/Documents/Specification%20Sheets%20and%20Brochures/Industries/Oil%20and%20Gas/P403984%20Huff%20n%20Puff.pdf?la=en.

Sheng, J. J. and Chen, K. 2014. Evaluation of the EOR Potential of Gas and Water Injection in Shale Oil Reservoirs, *Journal of Unconventional Oil and Gas Resources,* 5, 1-9 ("Sheng 2014").

Sheng, J. J. 2015. Enhanced oil recovery in shale reservoirs by gas injection, Journal of Natural Gas Science and Engineering, 22, 252-259 (invited review) ("Sheng 2015 A").

Sheng, J. J. 2015. Increase liquid oil production by huff-n-puff of produced gas in shale gas condensate reservoirs, Journal of Unconventional Oil and Gas Resources, 11, 19-26 ("Sheng 2015 B").

Sheng, J. J., Cook, T., Barnes, W., Mody, F., Watson, M., Porter, M., Viswanathan, H. 2015. Screening of the EOR Potential of a Wolfcamp Shale Oil Reservoir, paper ARMA 15-438 presented at the 49th US Rock Mechanics/Geomechanics Symposium held in San Francisco, Calif., USA, 28 June-1 July ("Sheng 2015 C").

Shoaib, S., Hoffman, B. T., 2009. $CO_2$ flooding the elm coulee field. In: Paper SPE 123176 Presented at the SPE Rocky Mountain Petroleum Technology Conference, 14-16 April, Denver, Colo. ("Shoaib 2009").

Transparency Market Research (TMR). April 2014. Enhanced Oil Recovery (EOR) Market: Global Industry Analysis, Size, Share, Growth, Trends and Forecast, 2013-2023. ID 2829851 ("TMR 2014").

Wan, T., Sheng, J. J., and Soliman, M. Y. 2013. Evaluation of the EOR Potential in Shale Oil Reservoirs by Cyclic Gas Injection, paper SPWLA-D-12-00119 presented at the SPWLA 54th Annual Logging Symposium held in New Orleans, La., 22-26 June ("Wan 2013 A").

Wan, T., Sheng, J. J., and Soliman, M. Y. 2013. Evaluation of the EOR Potential in Fractured Shale Oil Reservoirs by Cyclic Gas Injection, paper SPE 168880 or URTeC 1611383 presented at the Unconventional Resources Technology Conference held in Denver, Colo., USA, 12-14 Aug. 2013 ("Wan 2013 B").

Wan, T., Meng, X., Sheng, J. J., Watson, M. 2014. Compositional Modeling of EOR Process in Stimulated Shale Oil Reservoirs by Cyclic Gas Injection, paper SPE 169069 presented at the SPE Improved Oil Recovery Symposium, 12-16 April, Tulsa, Okla. ("Wan 2014").

Wan, T., Yu, Y, and Sheng, J. J. 2014b. Comparative Study of Enhanced Oil Recovery Efficiency by CO2 Injection and CO2 Huff-n-Puff in Stimulated Shale Oil Reservoirs, paper 358937 presented at the AIChE annual meeting, Atlanta, Ga., USA, 16-21 November ("Wan 2014 B").

Wan, T., Yu, Y., and Sheng, J. J. 2015. Experimental and Numerical Study of the EOR Potential in Liquid-Rich Shales by Cyclic Gas Injection, submitted to J. of Unconventional Oil and Gas Resources ("Wan 2015").

Wang, X., Luo, P., Er, V, Huang, S. 2010. Assessment of $CO_2$ Flooding Potential for Bakken Formation, Saskatchewan, paper SPE-137728-MS presented at the Canadian Unconventional Resources and International Petroleum Conference, 19-21 October, Calgary, Alberta, Canada ("Wang 2010").

Yu, W., Lashgari, H., Sepehrnoori, K. 2014. Simulation Study of CO2 Huff-n-Puff Process in Bakken Tight Oil Reservoirs, paper SPE 169575-MS presented at the SPE Western North American and Rocky Mountain Joint Meeting, 17-18 April, Denver, Colo. ("Yu 2014").

Yu, Y and Sheng, J. J. 2015. An Experimental Investigation of the Effect of Pressure Depletion Rate on Oil Recovery from Shale Cores by Cyclic N2 Injection, paper URTeC 2144010 presented at the Unconventional Resources Technology Conference held in San Antonio, Tex., USA, 20-22 July ("Yu 2015").

Cyclic stream stimulation design, July 2015, at http://petrowiki.org/Cyclic_steam_stimulation_design.

The disclosures of all patents, patent applications, and publications cited herein are hereby incorporated herein by reference in their entirety, to the extent that they provide exemplary, procedural, or other details supplementary to those set forth herein.

What is claimed is:

1. A method to increase hydrocarbon recovery in a hydrocarbon reservoir, wherein the method comprises the step of:

(a) determining a maximum injection rate and a maximum injection pressure in a well to be utilized during a plurality of huff periods in a huff-n-puff gas injection process;

(b) determining the maximum gas rate, the maximum oil production rate, and the minimum production pressure from the well during a plurality of puff periods in the huff-n-puff gas injection process;

(c) setting huff period time for the plurality of huff periods such that pressure near wellbore of the well reaches the determined maximum injection pressure during the huff period;

(d) setting puff period time for the plurality of puff periods such that pressure at the near wellbore reaches the determined minimum production pressure; and (e) performing the huff-n-puff gas injection process comprising the plurality of huff periods and the plurality of puff periods to increase recovery of hydrocarbons in the hydrocarbon reservoir, wherein the huff process is performed for the huff period time and the puff process is performed for the puff period time during the huff-in-puff gas injection process.

2. The method of claim 1, wherein the huff-n-puff gas injection process does not include a soaking step between the huff process and the puff process.

3. The method of claim 1, wherein the huff-n-puff gas injection process comprises a soaking period after the huff process and before the puff process in the huff-n-puff injection process.

4. The method of claim 1, wherein the huff process comprises the injection of a gas selected from the group consisting of methane, natural gas, carbon dioxide, nitrogen, and combinations thereof.

5. The method of claim 1, wherein the step of determining the maximum injection rate and the maximum injection pressure during the huff periods is determined based upon at least one of facility capacities, reservoir conditions, and operation constraints.

6. The method of claim 1, wherein the step of determining the maximum gas rate, the maximum oil production rate, and the minimum production pressure during the puff periods is determined based upon at least one of facility capacities, reservoir conditions, and operation constraints.

7. The method of claim 1, wherein the step of determining the maximum injection rate and the maximum injection pressure during the huff periods is comprises performing a test of the well to determine the time it takes for downhole pressure of the well to reach the maximum injection pressure when starting at the minimum production pressure.

8. The method of claim 1, wherein the step of determining the maximum gas rate, the maximum oil production rate, and the minimum production pressure during the puff periods comprises performing a test of the well to determine the time it takes for production pressure of the well to reach the minimum production pressure when starting at the maximum injection pressure.

* * * * *